US005244273A

United States Patent [19]

Kaspar et al.

[11] Patent Number: 5,244,273

[45] Date of Patent: Sep. 14, 1993

[54] DOOR HOLD-OPEN DEVICE

[75] Inventors: Melvin C. Kaspar; Jeffery T. Kostos, both of LaGrange Park, Ill.

[73] Assignee: Ardco, Inc., Chicago, Ill.

[21] Appl. No.: 746,321

[22] Filed: Aug. 16, 1991

[51] Int. Cl.[5] ..... F25D 11/00

[52] U.S. Cl. ..... 312/405; 49/322; 16/82

[58] Field of Search ..... 16/82, 85, 86 C; 49/322; 312/405

[56] References Cited

U.S. PATENT DOCUMENTS 3,103,692 9/1963 Ruck et al. ..... 16/82

3,980,331 9/1976 Kennedy et al. ..... 16/82

*Primary Examiner*—Kenneth J. Dorner

*Assistant Examiner*—Gerald A. Anderson

*Attorney, Agent, or Firm*—Leydig, Voit & Mayer

[57] ABSTRACT

A device for automatically holding a refrigerator door releasably in a fully open position relative to a refrigerated display cabinet. The device includes an elongated spring arm connected pivotally to a frame member of the cabinet and formed with an elongated slot which receives a pin connected to a frame member of the door. The pin slides in the slot and causes the arm to pivot outwardly as the door is swung open. As the door approaches its fully open position, the pin cams past detent lugs in the slot and then engages the lugs to prevent the door from closing unless the door is swung closed with sufficient force to cause the pin to cam reversely past the detent lugs.

11 Claims, 2 Drawing Sheets

DOOR HOLD-OPEN DEVICE

BACKGROUND OF THE INVENTION

This invention relates generally to a commercial refrigerator door and, more particularly, to a device for releasably holding the door in an open position relative to a refrigerated display cabinet.

Commercial refrigerator doors commonly comprise a sturdy frame and a plurality of spaced glass panes and, as a result, are relatively heavy. Hold-open devices for such doors are disclosed in Heaney U.S. Pat. No. 3,986,742 and Kaspar U.S. Pat. No. 4,428,096. The Heaney hold-open device also forms part of a door stop. It requires several components and must be very strong and structurally sound in order to stop the heavy door in its fully open position. The hold-open device disclosed in the Kaspar patent also requires several components and is rather complex.

Niekrasz U.S. Pat. No. 4,416,086 discloses a commercial refrigerator door with a relatively simple hold-open device. That device, however, must be moved manually between operative and inoperative positions and does not operate automatically as an incident to swinging the door.

SUMMARY OF THE INVENTION

The general aim of the present invention is to provide a new and improved door hold-open device which is relatively simple and inexpensive while being automatically engageable and releasable upon manual opening and closing of the door.

A further object of the invention is to reduce the complexity and the cost of the hold-open device by divorcing the hold-open device from the door stop.

A more detailed object is to achieve the foregoing by providing a hold-open device in the form of a forked spring arm which swings outwardly upon opening of the door, allows the door to move to its fully open position and then releasably holds the door against returning to its closed position.

These and other objects and advantages of the invention will become more apparent from the following detailed description when taken in conjunction with the accompanying drawings.

DETAILED DESCRIPTION OF THE PREFERRED EMBODIMENT

Figure 1:
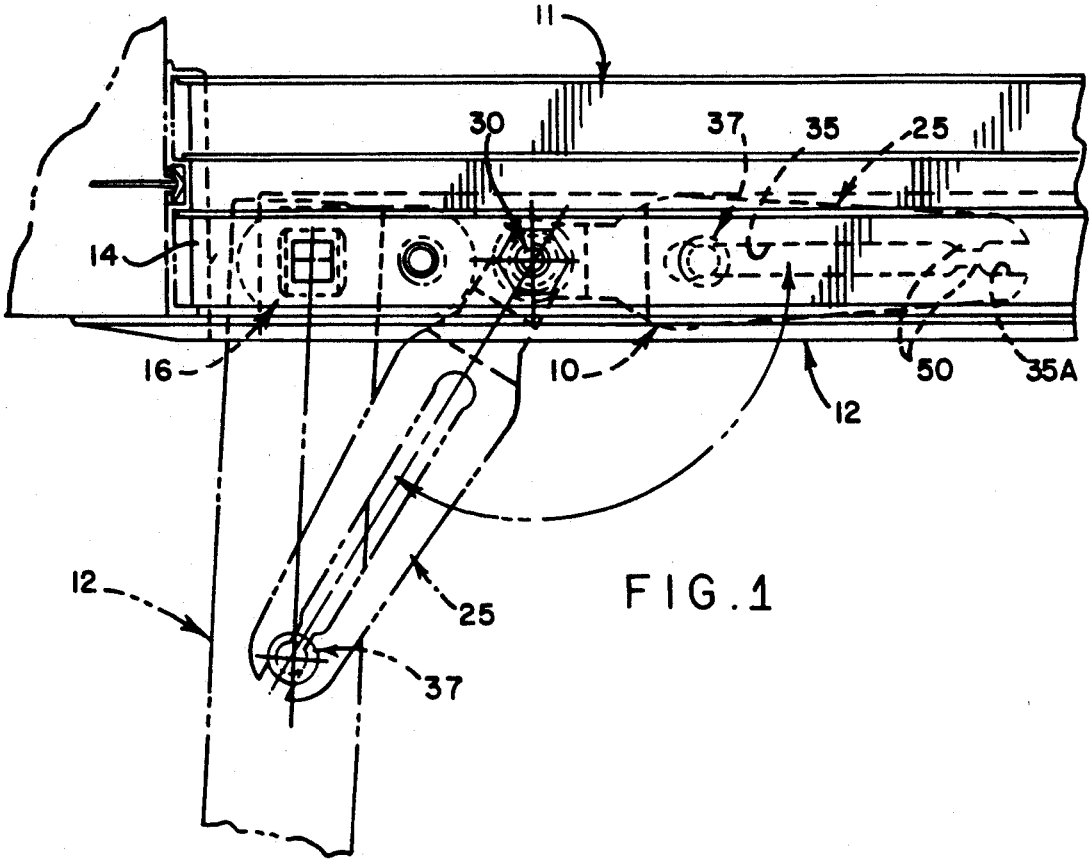
FIG. 1 is a fragmentary top plan view of a refrigerated display cabinet and a refrigerator door equipped with a new and improved hold-open device incorporating the unique features of the present invention.

For purposes of illustration, the hold-open device 10 of the present invention has been shown in the drawings in conjunction with a commercial refrigerated display cabinet 11 adapted to be closed by a hinged door 12. The hold-open device which has been illustrated is located at the upper end of the door while an identical device (not shown) may be located at the lower end of the door.

The cabinet 11 and the door 12 themselves are of conventional construction and will be described only briefly. The cabinet 11 includes an upper horizontally extending frame member 14 (FIG. 3) which defines part of a rectangular opening 15 adapted to be closed by the door 12. An upper hinge assembly 16 (FIG. 2) is connected to the frame member 14 and coacts with a lower hinge assembly (not shown) to support the door for swinging between open and closed positions about a vertical axis located adjacent one edge of the door. A door stop (not shown) on the lower end of the door engages an adjacent part of the cabinet to prevent the door from opening beyond just slightly more than ninety degrees. The door stop may be of the same type as disclosed in the aforementioned Niekrasz patent.

The door 12 includes three spaced glass panes in (FIG. 3) whose upper ends are located adjacent an upper horizontally extending frame member 20 of the door. The hinge assembly 16 is connected to the upper frame member 20 and, when the door is in its closed position, the upper frame member 20 of the door is located within the opening 15 of the cabinet 11 and is spaced directly below the frame member 14 of the cabinet. A sealing gasket 21 extends around the periphery of the inner face of the door and engages a door jamb 22 on the cabinet when the door is closed.

In accordance with the present invention, provision is made of an extremely simple device 10 for automatically holding the door 12 releasably in its open position and preventing the door from closing unless the door is intentionally swung toward its closed position. Herein, the hold-open device includes a forked arm 25 made of resiliently yieldable material and supported to pivot outwardly as the door is opened. As the door approaches its fully open position, the forked end portion of the arm flexes to permit full opening of the door and then springs back to its original position creating a detent action hold the door releasably in its open position.

More specifically, the arm 25 is stamped from an elongated piece of steel and is formed with an inner pivot portion or ear 26 (FIG. 6) which, in this particular instance, is pivotally connected to the frame member 14 of the cabinet 11 to support the arm to swing about an axis extending parallel to and spaced laterally from the hinge axis of the door 12 as defined by the hinge assembly 16. For this purpose, a vertically extending hole 27 is formed through the ear 26 and pivotally receives the smooth shank portion of a shoulder bolt 30 (FIG. 3) formed with a flanged head 31 and having a threaded shank portion extending through a vertical hole 32 in the frame member 14. The bolt 30 is captivated on the frame member 20 by a nut 33 and supports the arm 25 to pivot outwardly relative to the frame member from a normal position shown by dotted lines in FIG. 1 to an extended position shown in dash-dot lines.

A downwardly inclined portion 34 (FIGS. 2 and 6) is integral with the outer end of the mounting ear 26 of the arm 25 and joins the ear to the main portion of the arm. In this instance, the main portion of the arm is defined by two laterally spaced and elongated arm sections 25A (FIG. 6) which are separated from one another by virtue of an elongated slot 35 formed vertically through the arm and opening out of the outer free end thereof. The arm sections 25A are located above the horizontal frame member 20 of the door 12 and, when the door is closed, the entire arm 25 is positioned between the frame member 20 and the upper frame member 14 of the cabinet 11 and is disposed inwardly beyond the front surfaces of the frame members so as to be substantially concealed from view.

Figure 2:
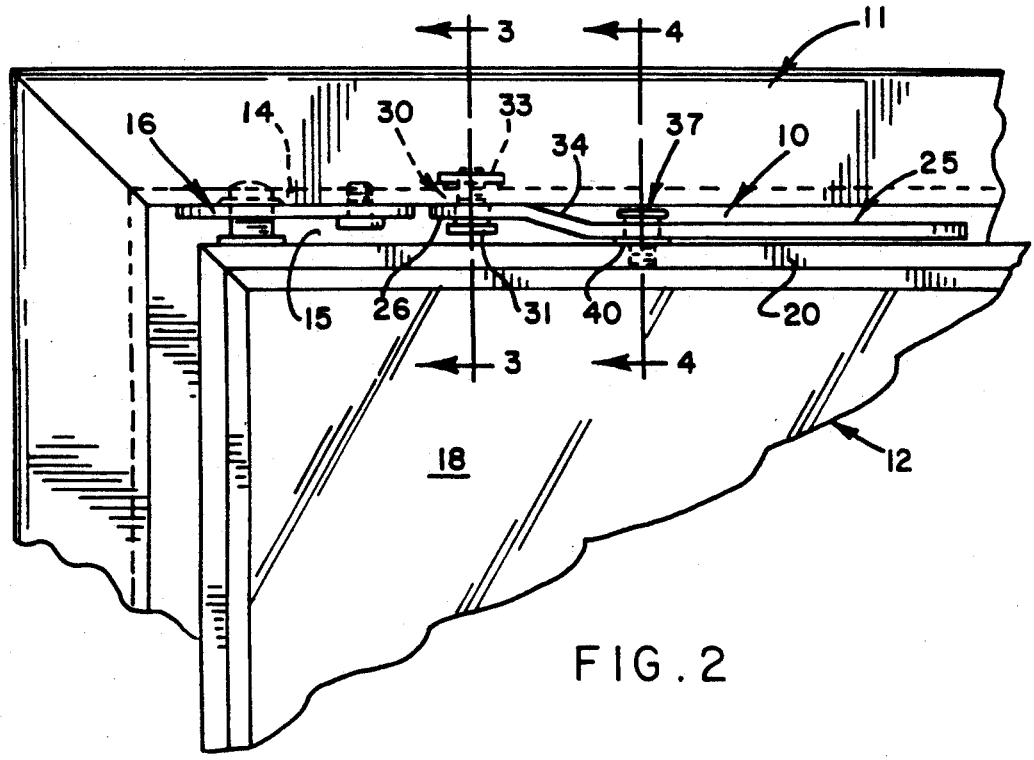
FIG. 2 is a front elevational view of the cabinet, the door and the hold-open device shown in FIG. 1.
Figure 3:
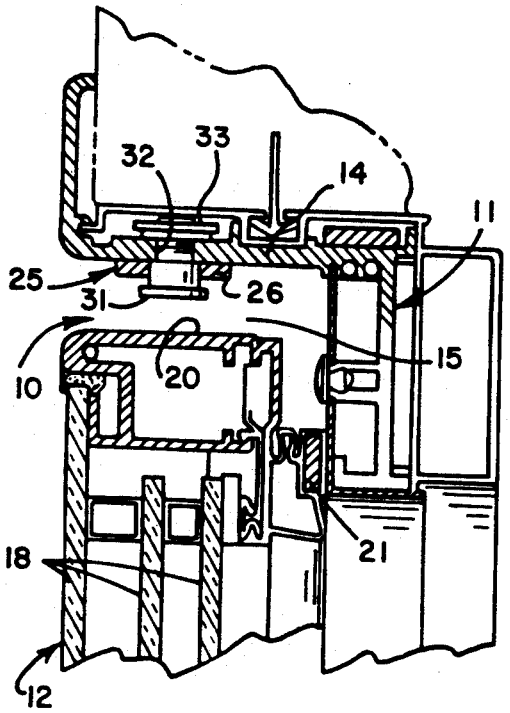
FIGS. 3 and 4 are enlarged fragmentary cross-sections taken substantially along the lines 3—3 and 4—4, respectively, of FIG. 2.
Figure 4:
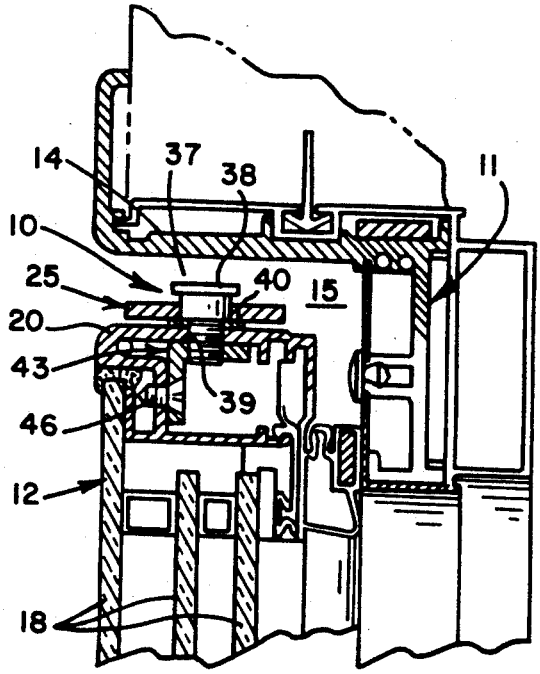

As shown most clearly in FIGS. 1, 2 and 4, a vertically extending pin 37 is connected to the frame member 20 of the door 12 and is received with a slidable fit in the slot 35 in the arm 25. The pin 37 also is in the form of a shoulder bolt formed with an upper head or flange 38 (FIG. 4), a smooth shank portion and a threaded shank portion. The flange 38 is located above the arm 25 with the smooth shank portion disposed in the slot 35 and with the threaded shank portion extending through a hole 39 in the upper frame member 20 of the door. A metal or plastic washer 40 encircles the threaded shank portion of the pin 37 and holds the arm 25 in upwardly spaced relation from the frame member 20.

Figure 5:
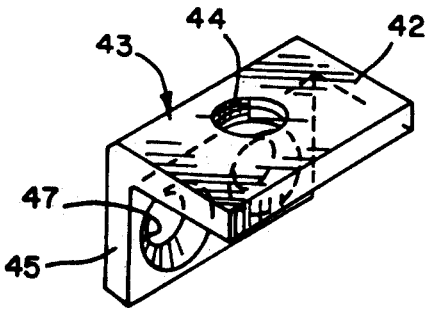
FIG. 5 is a perspective view of a mounting bracket for one of the components of the hold-open device.

In order to anchor the pin 37 securely to the frame member 20, one flange 42 (FIG. 5) of a steel angle bracket 43 underlies the frame member and is formed with a tapped hole 44 for receiving the threaded shank portion of the pin. The other flange 45 of the bracket lies against another portion of the frame member 20 and is secured thereto by a self-tapping screw 46 (FIG. 4) which extends through a hole 47 in the flange. It will be understood that alternatively the pin 37 may be mounted for floating or relatively limited movement with respect to the frame to better accommodate tolerances between the door and frame.

When the door 12 is fully closed, the pin 37 is located near the closed end of the slot 35 as shown in dotted lines in FIG. 1. As the door is swung outwardly to its open position, the pin 37 slides along and acts against the outer edge of the slot 35 to cause the arm 25 to swing outwardly about the pin 30 and move to the extended position shown in phantom in FIG. 1.

In carrying out the invention, the pin 37 cams past detent means 50 (FIG. 6) and causes the two arm sections 25A to spread away from one another as the door 12 approaches its open position and as the pin approaches the outer end of the slot 35. After the pin 37 passes the detent means, the two arm sections spring back toward one another and, as an incident thereto, the pin engages the detent means to hold the door releasably in its open position.

Figure 6:
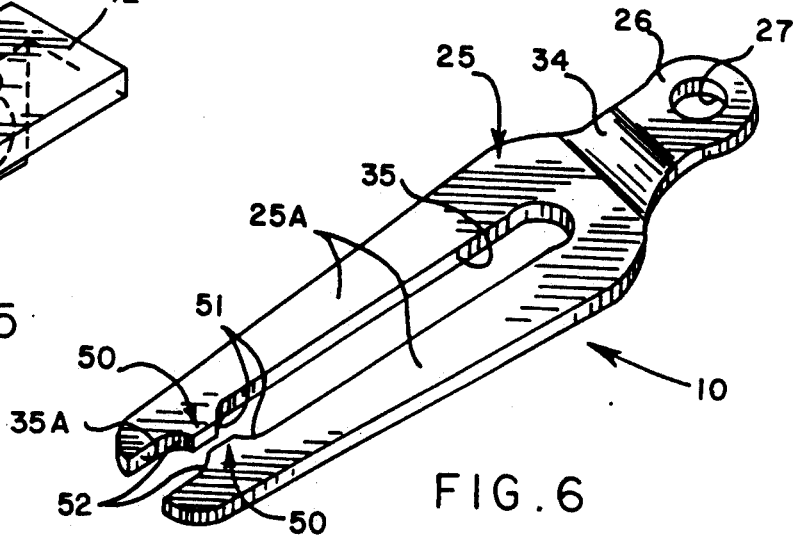
FIG. 6 is a perspective view of the spring arm of the hold-open device.

As shown most clearly in FIG. 6, the detent means 50 preferably is in the form of a pair of laterally opposed lugs which are integral with and project laterally inwardly from the edges of the slot 35 near the open end thereof, the lugs thus significantly reducing the lateral width of the slot in the vicinity of the lugs. The inner end of each lug 50 is formed with a concavely curved cam surface 51 while the outer end of each lug is formed with a similarly curved cam surface 52. A relatively short slot portion 35A is located outwardly of the lugs and opens out of the free end of the arm 25.

With the foregoing arrangement, the smooth shank portion of the pin 37 engages the cam surfaces 51 of the lugs 50 as the door 12 approaches its open position. By virtue of such engagement and with continued opening of the door, the pin cams the arm sections 25A apart and moves past the lugs. As soon as the pin clears the lugs, the arm sections spring together and return the lugs to their original position shown in FIG. 6. The pin clears the lugs and fully enters the outer slot portion 35A just shortly before or at the same time that the door reaches its fully open position and is stopped by the lower door stop.

With the pin 37 located in the outer slot portion 35A, the detent lugs 50 restrict inward movement of the pin and thus restrict closing of the door 12. In order to close the door, the door must be swung toward its closed position with such force that the pin engages the cam surfaces 52 and spreads the arm sections 25A sufficiently to enable the pin to move inwardly past the lugs and into the main length of the slot 35.

In order to reduce stress in the arm sections 25A, the outer edges of the arm sections are inclined so as to taper toward one another as the arm sections progress toward the free end of the arm 25. Also, the closed end of the slot 35 is defined by a semicircle having a radius somewhat larger than one-half the lateral width of the slot.

Since the device 10 only serves to hold the door 12 open and is not required to stop the door, the device is of relatively lightweight and inexpensive construction, requires relatively few components and need not be anchored in an extremely strong manner to the frame member 14 of the cabinet 11. The device may be used equally well with a door which is hinged to the opposite side of the cabinet opening 15 simply by forming holes corresponding to the holes 32 and 39 in appropriate locations in the opposite end portions of the frame members 14 and 20, respectively. The two shoulder bolts 30 and 37 automatically accommodate the arm 25 even if the tolerances of the cabinet 11 and the door 12 are such that the vertical spacing between the frame members 14 and 20 is significantly greater than shown in FIGS. 3 and 4. And as mentioned above, the arm 25 lies between the two frame members and does not project outwardly beyond the frame members when the door is fully closed.

We claim:

1. A device for releasably holding a hinged door member in an open position relative to a door frame member, said device comprising a one-piece elongated arm made of resiliently yieldable material and having one end adapted to be connected to one of the members to swing about an axis extending parallel to the hinge axis of the door member, said arm having a main portion formed with an elongated slot opening out of the free end thereof, said slot terminating short of said one end and dividing said arm into two laterally spaced, resilient cantilevered arm sections, said arm sections each having a lateral width that progressively decreased as such arm section proceeds toward the free end of the arm for reducing stress concentrations in said arm upon further lateral separation of said arm sections, a pin slidable within said slot and adapted to be connected to the other of said members, said pin being received in one end portion of said slot and being located adjacent said one end of said arm when said door member is in said closed position, movement of said door member toward said open position causing relative sliding of said pin and said slot along the length of the slot, and detent means integral with said arm sections and reducing the lateral width of said slot adjacent the free ends of said arm sections and between the ends of the slot, said pin and said detent means camming against one another as said door approaches said open position and thereafter engaging one another to hold said door releasably in said open position.

2. A device as defined in claim 1 in which said arm is adapted to be connected to said frame member and in which said pin is adapted to be connected to said door member.

3. A device as defined in claim 1 in which said detent means is defined by two laterally opposing and laterally spaced lugs located between the ends of said slot.

4. A device as defined in claim 1 in which said arm includes an integrally formed inclined portion connecting said one end to said main portion.

5. A device for releasably holding a hinged door in an open position relative to a door frame, said device comprising an elongated arm made of resiliently yieldable material and having a pivot end portion adapted to be connected to said frame to swing about a predetermined axis spaced from and extending parallel to the hinge axis of the door, an elongated slot formed through said arm and opening out of the free end thereof, said slot terminating short of the pivot end portion of said arm and dividing said arm into two laterally spaced and cantilevered arm sections, said arm sections each having a lateral width that progressively decreases as such arm section proceeds toward the free end of the arm for reducing stress concentration in said arm upon further lateral separation of said arm sections, a pin adapted to be connected to said door and projecting slidably into said slot between said arm sections, said pin being received in a first end portion of said slot when said door is in said closed position and sliding within said slot and causing said arm to swing about said predetermined axis as said door is swung toward said open position, and laterally inwardly projecting lugs integral with said arm sections and reducing the lateral width of said slot adjacent the free end of said arm and between the ends of the slot, said pin camming against said lugs and causing said arm sections to cam laterally outwardly with respect to each other as said door approaches said open position, said arm sections springing laterally inwardly after said pin passes said lugs during continued movement of said door to said open position wherby said pin engages said lugs to hold said door releasably in said open position.

6. A device as defined in claim 5 in which said slot includes a closed end defined by a semicircle having a radius greater than one-half the lateral width of the slot.

7. The combination of, a refrigerator cabinet having a door-receiving opening and having a generally horizontal frame member defining part of said opening, a refrigerator door mounted on said cabinet to swing outwardly about an upright hinge axis from a closed position to an open position, said door having a generally horizontal member located within said opening and spaced vertically from said frame member when said door is in said closed position, and means for releasably holding said door in said open position, said means comprising a one-piece elongated arm made of resiliently yieldable material, said arm having a mounting ear at one end connected to said frame member to swing about an upright axis spaced horizontally from said hinge axis, said arm being formed with an elongated slot opening out of the free end thereof, said slot dividing said arm into two laterally spaced, cantilevered resilient arm sections which define two laterally spaced edges, said arm sections each having a lateral width that progressively decreases as the arm section proceeds toward the free end of the arm for reducing stress concentrations in said arm upon further lateral separation of said arm sections, an upright pin connected to said horizontal member of said door and projecting slidably into said slot, said pin being received in a first end portion of said slot when said door is in said closed position and sliding within said slot and causing said arm to pivot outwardly as said door is swung outwardly toward said open position, and detent means integral with said arm and reducing the lateral width of said slot adjacent the free end of said arm and between the ends of said slot, said pin camming past said detent means as said door approaches said open position and thereafter engaging said detent means to hold said door releasably in said open position.

8. The combination defined in claim 7 in which said arm is sandwiched between said frame member and said horizontal member of said door when said door is in said closed position.

9. The combination defined in claim 7 in which said detent means is defined by two laterally opposing and laterally spaced lugs located between the ends of said slot and projecting toward one another from opposing edges of the slot.

10. The combination defined in claim 9 in which each of said lugs includes a first curved cam surface which said pin engages as said door is swung toward said open position and further includes a second curved cam surface which said pin engages as said door is swung toward said closed position.

11. The combination as defined in claim 7 in which said arm includes an integrally formed inclined portion connecting said mounting ear to said main portion.

* * * * *